US005855360A

United States Patent [19]

Wurdack

[11] Patent Number: 5,855,360

[45] Date of Patent: Jan. 5, 1999

[54] MODULAR PANEL LIFTER AND ADAPTER

[76] Inventor: Roy A. Wurdack, 9302 Rockshire La., Chattanooga, Tenn. 37421

[21] Appl. No.: 792,671

[22] Filed: Jan. 29, 1997

[51] Int. Cl.[6] ..... B66F 3/36

[52] U.S. Cl. ..... 254/100; 254/133 R; 254/102; 254/134

[58] Field of Search ..... 254/100, 102, 254/103, 131, 133 R, 134, 7 R, 7 B, 13

[56] References Cited

U.S. PATENT DOCUMENTS

| | | | |
|---|---|---|---|
| 18,760 | 12/1857 | Miller | 254/100 |
| 66,170 | 6/1867 | Patterson . | |
| 1,911,101 | 5/1933 | Adell | 254/102 |
| 2,013,918 | 9/1935 | Kelleher | 254/133 |
| 2,107,717 | 2/1938 | Smith | 254/100 |
| 2,237,230 | 4/1941 | Johnson | 254/98 |
| 2,504,201 | 4/1950 | Johnson | 254/100 |
| 2,650,795 | 9/1953 | Bell | 254/100 |
| 2,910,270 | 10/1959 | Schultz | 254/98 |
| 2,980,397 | 4/1961 | Lucker | 254/99 |
| 3,382,988 | 5/1968 | O'Reilly | 214/1 |
| 3,426,752 | 2/1969 | Laico | 128/83 |
| 4,247,083 | 1/1981 | Koffski | 254/107 |
| 4,486,443 | 12/1984 | Collins et al. | 254/8 B |
| 4,609,179 | 9/1986 | Chern et al. | 254/102 |
| 5,118,082 | 6/1992 | Byun | 254/102 |
| 5,131,629 | 7/1992 | Hillhouse | 254/133 R |
| 5,261,643 | 11/1993 | Wurdack | 254/106 |
| 5,340,083 | 8/1994 | Suhy et al. | 254/100 |
| 5,379,987 | 1/1995 | Cleary | 254/134 |
| 5,385,335 | 1/1995 | Wurdack | 254/1 |

*Primary Examiner*—David A. Scherbel
*Assistant Examiner*—Lee Wilson
*Attorney, Agent, or Firm*—Grace J. Fishel

[57] ABSTRACT

An electrical adapter fitting for use on modular furniture panels of a kind electricaly prewired with a raceway along a lower edge of the panel. The adapter being L-shaped in cross-section with upstanding fingers adapted to straddle an electrical raceway along a bottom side edge of the modular panel. The fingers adapted to support the panel by lateral side flanges flanking the raceway. A modular panel lifter for use with the electrical adapter fitting, or other adapters, having telescoping inner and outer sections and a jack screw for raising and lowering the outer section upon which the adapter may be mounted.

11 Claims, 4 Drawing Sheets

MODULAR PANEL LIFTER AND ADAPTER

BACKGROUND OF THE INVENTION

1. Field of the Invention

The present invention relates to a lifter for a modular panel and to a special electrical adapter fitting for use with modular panels of a kind electrically prewired with a raceway along a lower edge of the panel. More particularly, the invention is concerned with a combination tool including a lifter in accordance with the present invention and a special electrical adapter fitting, which can be used with other lifters, for raising modular partitions or modular panels with electrical raceway systems at the bottom of the partition or panel, for the purpose of installing a floor covering, making floor repairs, removing and installing carpeting, leveling partitions or panels on uneven floors or reconfiguring the panels.

2. Brief Description of the Prior Art

Wall structures formed from a plurality of prefabricated panels are used extensively in commercial and industrial buildings for dividing interior regions of the building into smaller working spaces. Such structures have proven particularly effective in creating a sense of place which is very important to people, while additionally minimizing noise.

When the carpeting under a modular system wears out or when it necessary to make floor repairs, level the partitions or panels on uneven floors or to reconfigure the panels, the modular furniture must be disassembled. This is an expensive and disruptive procedure as each desk and work area must be cleared of all business supplies and personal items. Computer, telephone, telex and other communication systems must be disconnected and all equipment removed. Each desk, bookshelf, or accessory must be removed from the furniture panels and the panels then disassembled.

In order to avoid the expense and disruption in disassembling modular furniture, there have been several types of lifting devices for raising and lowering the panels so that the floor or the panels can be worked on. Insofar as known, there is no tool that adequately addresses the problem of safely raising panels with an electrical raceway along the bottom edge. The modular panels manufactured and sold by Haworth, Inc. of Holland, Mich. are electrically prewired with electrical power blocks disposed adjacent opposite corners of the panel. The power blocks are interconnected by suitable wires or cables which extend through a channel, called a POWER BASE™ raceway, fixed to the lower edge of the panel. The raceway is particularly sensitive to lifting. Lifting at the panel channel supports is not possible, because the panel track is independent of the panels themselves. The track slides down and hooks into holes on the panel and lifting from the track will only dislodge the track from the hooks thereby lifting the track but not the panels, which may disconnect or short out the electrical system. What is needed is a special electrical adapter fitting that allows the panel to be lifted along the raceway without damaging the electrical connections.

Some panel systems, such as those sold by Steelcase, Inc. of Grand Rapids, Mich., have strips with slots upon which desks, bookshelves or accessories are hung and by which the panels can be lifted. In U.S. Pat. Nos. 5,261,643 and 5,385,335 to Wurdack, a method for lifting a panel with a rachet jack is described. The method makes use of a special three-fingered adapter that mates with the slots and is useful only with panels having such slots. The jacking mechanism, which was originally designed for use as a car jack, works on a rachet with a long leverage bar, giving the panel a shake with each click as the panel is lifted and raised. In addition, it is not always easy to find a location along a panel where there is enough space to use the long leverage bar without removing something from the panel.

In some modular panel configurations, a panel joins three or four other panels to form neighboring offices separated by common walls. Because of the weight of the desks, bookshelves and accessories hanging on the panels, it is necessary to apply a lifting force on more than one panel at such a corner to avoid undue torque and stress. With a crowbar or even a jack such as described in U.S. Pat. Nos. 5,261,643 and 5,385,335, it is very difficult to apply an equal force on the panels in the corners.

SUMMARY OF THE INVENTION

In view of the above, there is a need for a special electrical adapter fitting that can be used with the lifter device of the present invention, or with other jacks, for lifting panels having a raceway along a bottom edge. There is also a need for a lifter device which can be used to smoothly lift modular furniture, including panels joined to three or four other panels, particularly for use in combination with the above-mentioned special electrical adapter fitting. It is therefore an object to provide a lifter device and electrical adapter fitting which satisfies these needs. Another object is to provide a lifter device that can be used in tight places, making it unnecessary to remove anything from the panel system. Other objects and features of the invention will be in part apparent and in part pointed out hereinafter.

In accordance with the invention, a special electrical adapter fitting is L-shaped in cross-section with first and second orthogonal legs. The first leg is attached to a means for raising and lowering the adapter and the second leg has a pair of upstanding fingers adapted to straddle an electrical raceway flanked with lateral side edges along a bottom side edge of a modular furniture panel. The fingers are adapted to support the panel by the lateral side flanges.

A further aspect of the invention is a modular panel lifter for use with the special electrical adapter fitting described above or with other adapters. The panel lifter has inner and outer telescoping tubes. The inner tube has a first end with a surface engaging base and a fixed collar nut attached proximate a second end. A jack screw is threaded through the nut with a stop at a first end preventing unthreading of the screw from the nut. A female socket is attached to the screw at a second end for use in rotating the screw. An abutment shoulder is provided on the screw proximate the socket.

The outer tube has a first open end within which the inner tube is slidingly received and a second end within which is mounted the socket. A plate is provided in the second end of the second tube with an aperture in which the socket rotates. An axial thrust bearing is mounted on the jack screw between the abutment shoulder and the plate, the plate resting on the abutment shoulder through the axial thrust bearing. When an adapter is attached to the outer tube, the load on the adapter is transferred to the screw which can be used to raise and lower the load.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
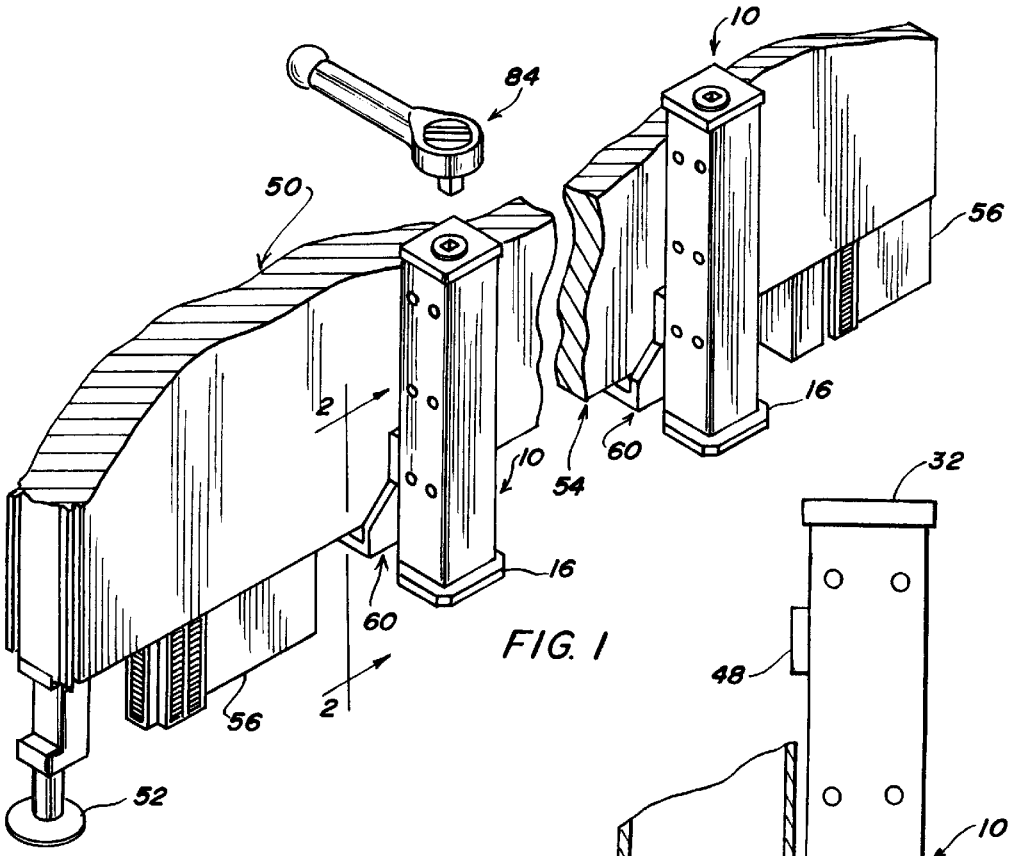
FIG. 1 a perspective view showing a pair of modular panel lifters in accordance with the present invention in use lifting a modular panel of the kind having a raceway along a lower edge of the panel.

Referring to the drawings more particularly by reference character, reference numeral 10 refers to a modular panel lifter in accordance with the present invention. Lifter 10 includes inner and outer telescoping tubes 12, 14. While not intending to be limited to any specifics, tubes 12, 14 may be formed of steel and square in cross section with outer tube 14 measuring 1¾" by 1¾" and inner tube 12 measuring 1½" by 1½" and having a wall thickness of 0.105 inch (12 U.S. standard gauge).

Figure 5:
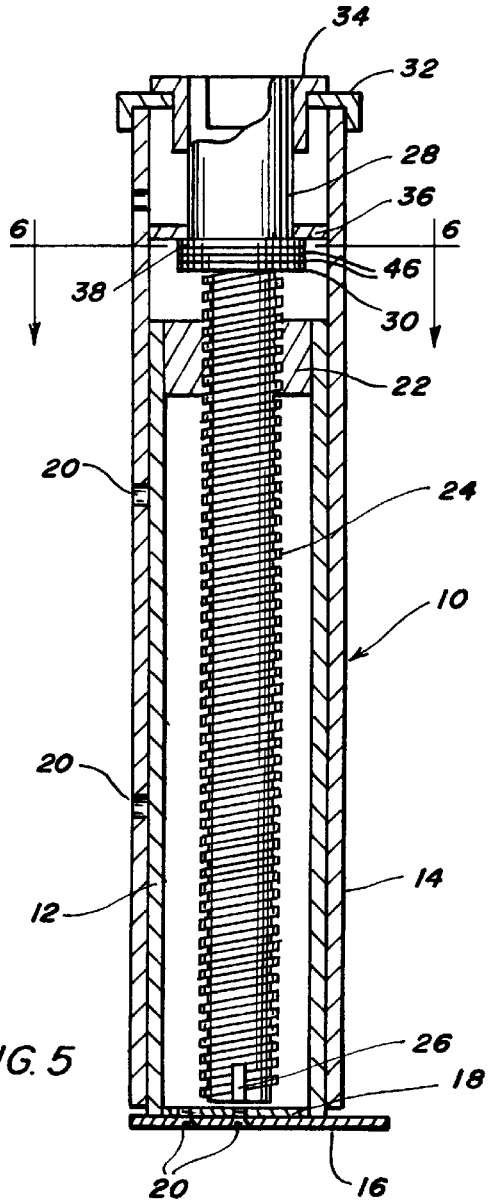
FIG. 5 is a section taken along line 5—5 in FIG. 4.
Figure 7:
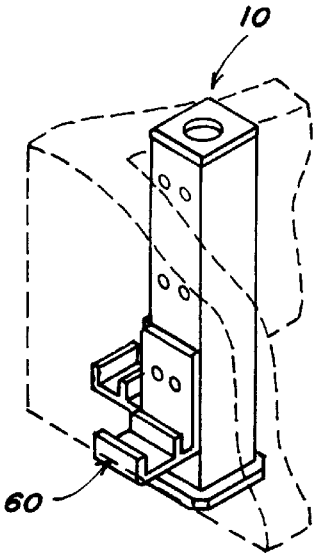
FIG. 7 is a perspective view of a modular panel lifter lifting a pair of panels connected at right angles.
Figure 6:
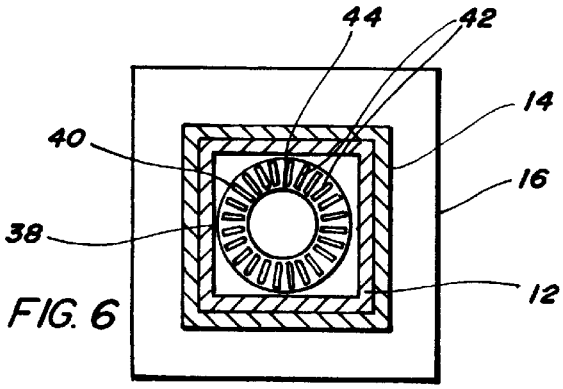
FIG. 6 is a section taken along line 6—6 in FIG. 5.

As best seen in FIG. 5, inner tube 12 has a first end with a surface engaging base 16 which is preferably detachable. For this purpose first end of inner tube 12 is sealed with a plate 18 to which base is attached with one or more screws 20. A fixed collar nut 22 is attached proximate a second end of inner tube 12. A jack screw 24, such as a ⅝" threaded screw shaft formed of hardened steel, is threaded through nut 22 and is pendently supported inside inner tube 12 with a stop 26 provided at a first end to prevent unthreading of the screw from the nut. A female socket 28, such as a ½" square drive with a left hand thread, is welded or otherwise attached to a second end of jack screw 24 by which the screw can be rotated. An abutment shoulder 30, illustrated as a thick washer welded to the screw, for use as more particularly described below, is provided on jack screw 24 proximate socket 28.

Outer tube 14 has a first end which is open, within which inner tube 12 is slidingly received, and a second end within which socket 28 is mounted. As illustrated in the drawings, the second end of outer tube 14 is capped with a cover plate 32 having an aperture within which is received a flanged bushing 34. Socket 28 is mounted and rotated in bushing 34. Spaced along outer tube 14 a distance from cover plate 32 is a second plate 36 with an aperture within which a lower end of socket rotates. Second plate 36 rests on abutment shoulder 30 of jack screw 24 through an axial thrust bearing 38, minimizing any sliding frictional contact between the shoulder and the second plate. In the form illustrated in the drawings, axial thrust bearing 38 is a nonseparable caged unit including an outer race 40, needle rollers 42 and an inner race 44. To further reduce friction, thrust bearing 38 is sandwiched between two hardened steel washers 46 which remain stationary with respect to shoulder 30 and second plate 36. A magnetic stabilizer 48 may be provided on outer tube 14 to help prevent lateral movement of panel lifter 10 as the panel is lifted. As panel lifter 10 extends under load, the load on the adapter is transferred to jack screw 24 which is laterally reinforced by inner and outer telescoping tubes 12, 14.

Figure 2:
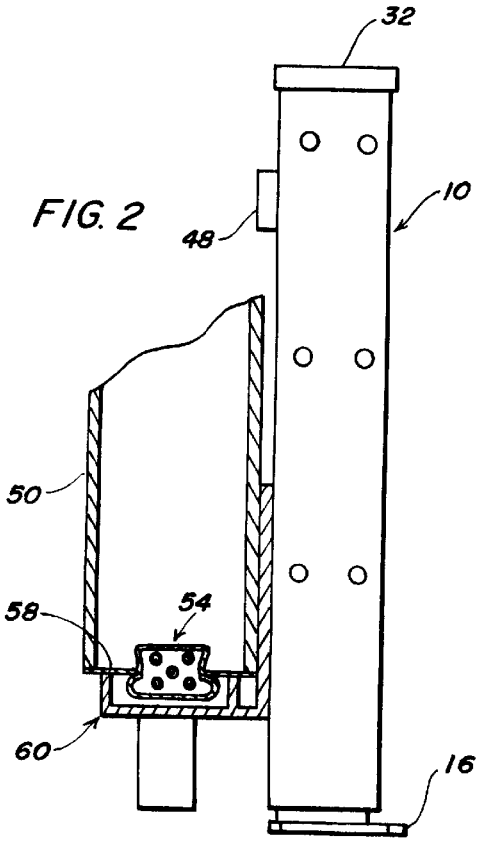
FIG. 2 is a side elevation of the panel lifter, partly in section, shown telescoped.
Figure 3:
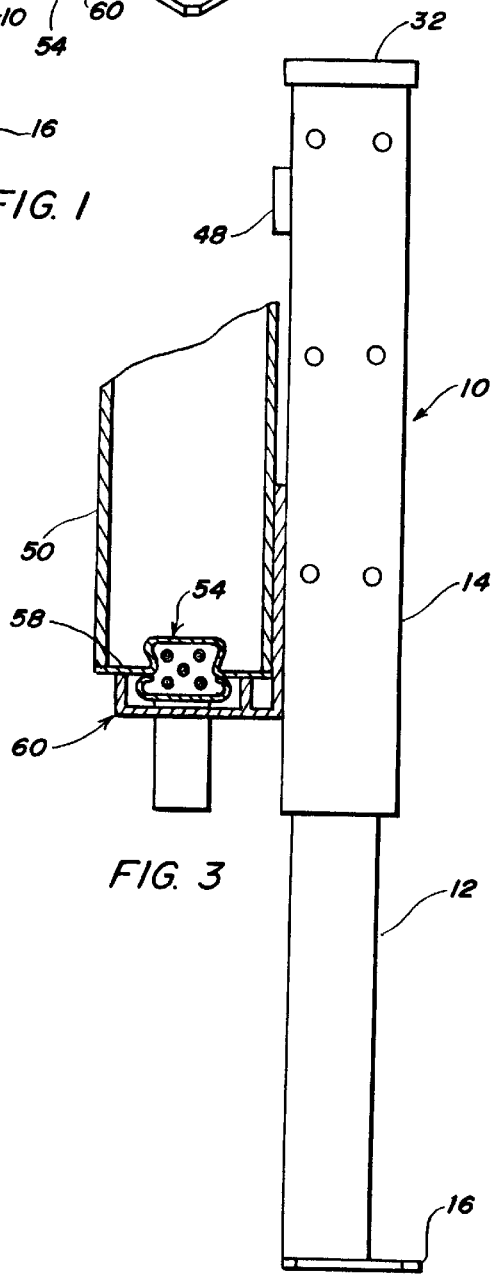
FIG. 3 is a side elevation of the panel lifter shown in FIG. 2 fully extended.
Figure 4:
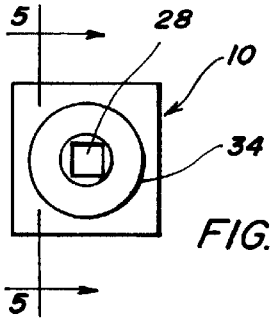
FIG. 4 is a view top view of the panel lifter.

A modular panel system is illustrated in FIGS. 1–3 wherein a panel 50 is shown being lifted off feet 52 by two of lifting devices 10. Panel 50 has a POWER BASE raceway 54 along its lower edge interconnecting a pair of power blocks 56 at adjacent opposite corners of the panel. Raceway 54 is of the kind flanked by lateral side flanges 58. In ordinary use, POWER BASE raceway 54 and power blocks 56 are concealed behind removable side panels (not shown).

Figure 9:
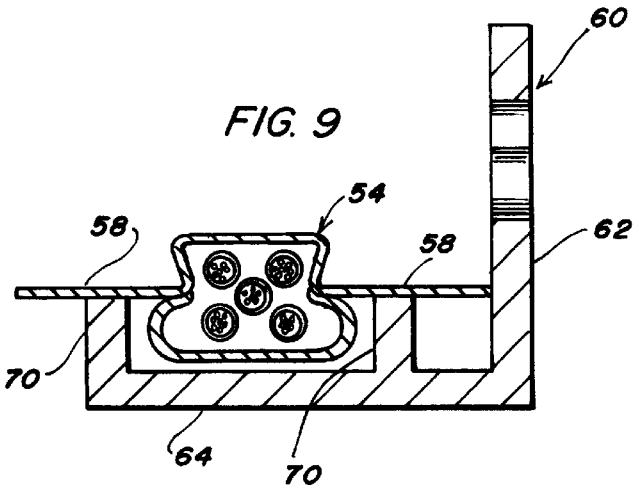
FIG. 9 is a side view in cross-section on an enlarged scale showing the electrical adapter fitting straddling a raceway and supporting a panel on a pair of flanking flanges.
Figure 8:
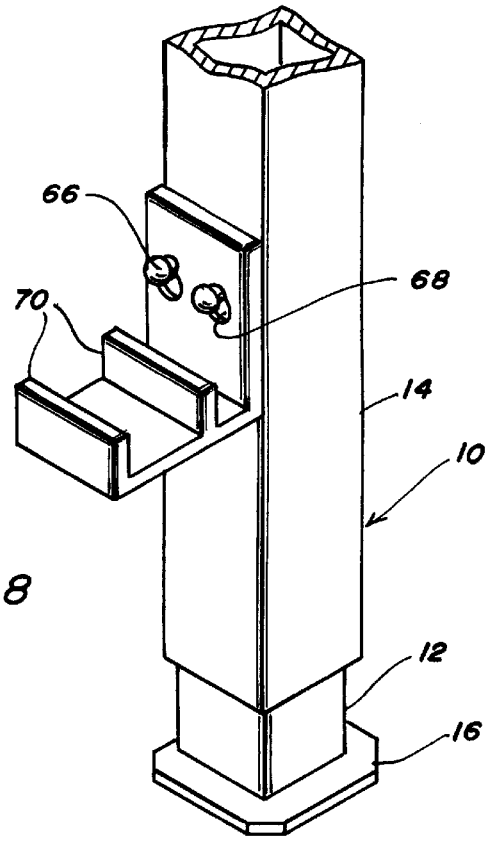
FIG. 8 is a perspective view of a special electrical adapter fitting in accordance with the present invention mounted on a panel lifter.

Panel 50 is supported on each lifting device 10 with an electrical adapter fitting 60. Referring now to FIG. 9, adapter 60 is L-shaped in cross-section with first and second orthogonal legs 62, 64, said adapter attached to the second tube by the first leg. As shown in FIG. 8, a plurality of posts 66 with enlarged heads may be stud welded or the like to the outside of outer tube 14. First leg 62 may be provided with holes 68 narrowing into a slot by means of which adapter 60 can be hung on posts 66. In the other drawings, adapter 60 is attached to outer tube 14 with screws 20, outer tube having been tapped for that purpose at selected, spaced intervals. Second leg 64 of adapter 60 has a pair of upstanding fingers 70 adapted to straddle raceway 54 and support panel 50 by lateral side flanges 58 which are strong enough to bear the weight.

Figure 11:
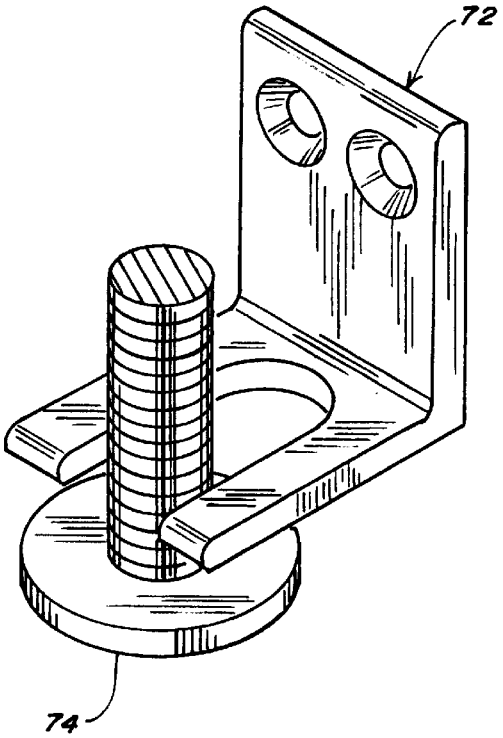
FIG. 11 is a perspective view of a second adapter for use with a panel lifter in accordance with the present invention.
Figure 12:
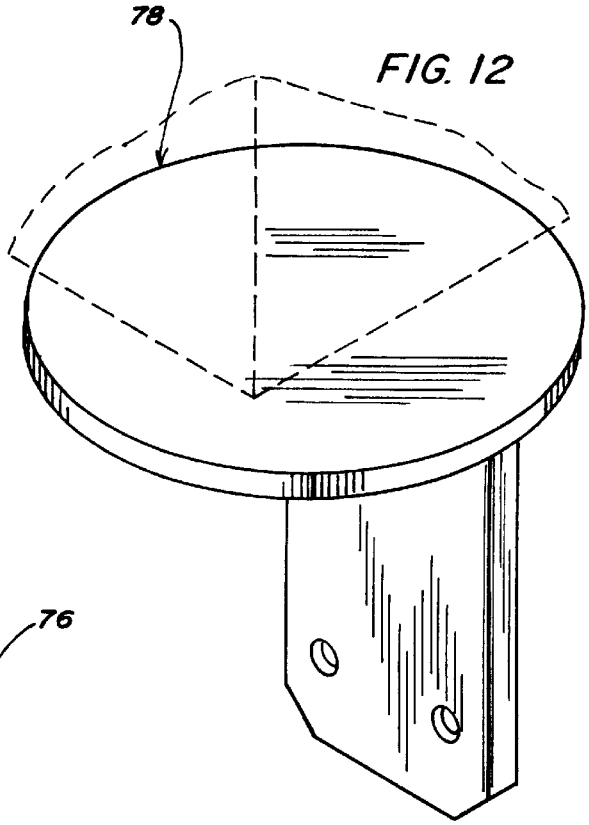
FIG. 12 is a perspective view of a third adapter.
Figure 13:
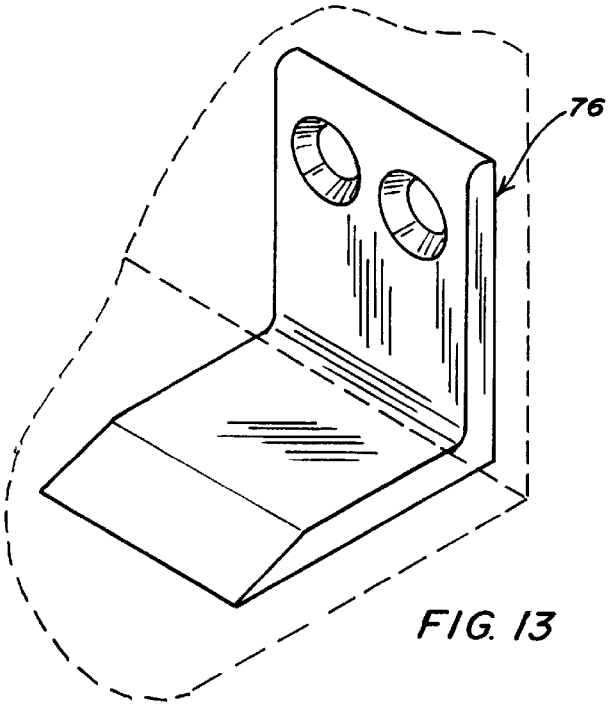
FIG. 13 is a perspective view of a fourth adapter.

In use, lifter device 10 can be used with other panel systems and for other purposes, not requiring the use of electrical adapter fitting 60. For example, adapter 72 as shown in FIG. 11 can be used for lifting a piece of furniture or the like supported on a threaded foot 74. Where the bottom edge of the panel does not include a raceway 54 as described above, an adapter 76 without fingers 70 as shown in FIG. 13 may be used or, in other cases, an adapter 78 like that shown in FIG. 12. Other adapters are possible and will occur to those skilled in the art.

Figure 10:
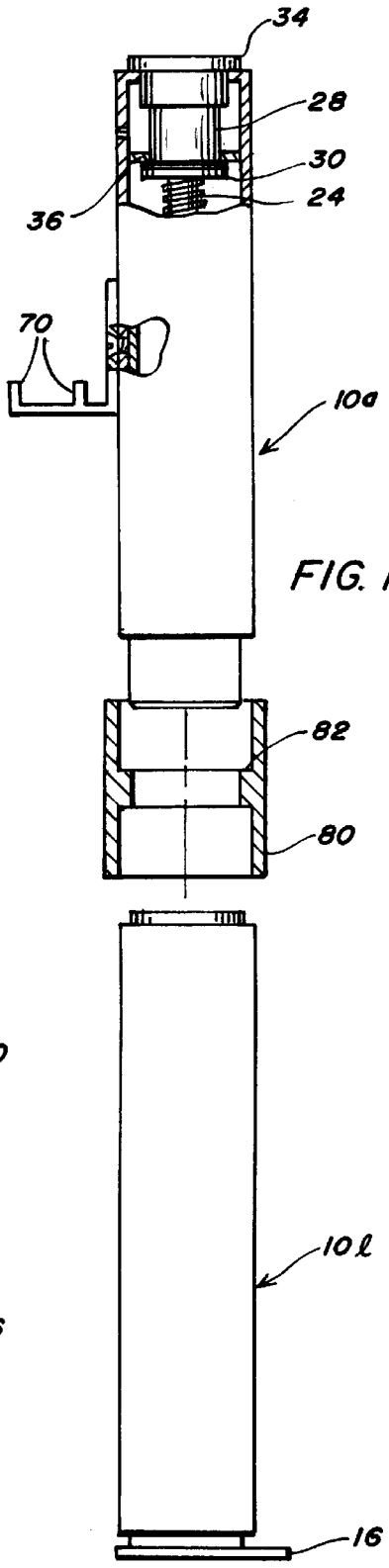
FIG. 10 is an exploded side view, partly in section, of two modular panel lifters linked end to end.

Panel lifter 10 is compact and can be operated in tight spaces. It is also very strong. For example, when inner tube is 6⅝" long and outer tube is 8⅝" long, panel lifter 10 telescopes to 8⅝" but extends to 15⅜". When an even higher lift is required, a pair of panel lifters 10 may be used as shown in FIG. 10. In this view a lower panel lifter 10L may be used telescoped or extended to the extent desired. Surface engaging base 16 is removed from upper panel lifter 10U and upper and lower panel lifters 10L, 10U coupled with a length of tubing (coupling) 80 into which an upper end of lower panel lifter and a lower end of upper panel lifter is received. Coupling 80 has a land 82 serving as a stop against which panel lifters 10L, 10U are seated.

In this configuration, paired panel lifters may be extended to about 30". For even higher lifts, panel lifters 10 can be longer, e.g. 12". For storage, however, each panel lifter measures just 8⅝" (or 12", etc.).

Panel lifter 10 operates very smoothly with a short handled rachet driver 84 as shown in FIG. 1 without jerking the panel. As long as the adapter attached to panel lifter 10 can be placed under the piece to be lifted, there is virtually no space too tight to use the lifter, by adjusting the position of driver 84 and the length of the stroke as needed.

When two or more panels are joined at right angles, panel lifter 10 can be used as shown in FIG. 8 to apply a lifting force on more than one panel at such a corner. In this mode, two electrical adapter fittings 60 are attached at the same level on adjacent sides of outer tube 14, lifting both panels simultaneously with undue torque and stress on the panels. Insofar as known, no other panel lifter has this capability.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A modular panel lifter comprising inner and outer telescoping tubes, said inner tube having a first end with a surface engaging base and a fixed collar nut attached proximate a second end, a jack screw threaded through said nut with a stop at a first end preventing unthreading of the screw from the nut and a female socket at a second end by which the screw can be rotated, said jack screw having an abutment shoulder proximate the socket, said outer tube having a first open end within which the inner tube is slidingly received and a second end within which is mounted said socket, a plate in said second end of the second tube with an aperture in which the socket rotates, an axial thrust bearing on the jack screw between the abutment shoulder and the plate, said plate resting on the abutment shoulder through said axial thrust bearing, an adapter for lifting objects attached to the outer tube whereby the load on the adapter is transferred to the screw, said screw laterally reinforced by the inner and outer telescoping tubes.

2. The modular panel lifter of claim 1 wherein the axial thrust bearing is a nonseparable caged unit including an outer race, needle rollers and an inner race.

3. The modular panel lifter of claim 2 wherein the thrust bearing is sandwiched between two hardened steel washers.

4. The modular panel lifter of claim 1 wherein the adapter is L-shaped in cross-section with first and second orthogonal legs, said adapter attached to the second tube by the first leg, said second leg having a pair of upstanding fingers adapted to straddle an electrical raceway along a bottom side edge of a modular furniture panel, said raceway flanked by lateral side flanges and said fingers adapted to support the panel by the lateral side flanges.

5. The modular panel lifter of claim 4 wherein the tubing is square in cross-section and two adapters are attached to adjacent sides of the outer tube for lifting two panels attached at right angles forming a corner.

6. The modular panel lifter of claim 1 wherein the surface engaging base is detachable.

7. The modular panel lifter of claim 1 wherein the abutment shoulder is a washer welded on the jack screw.

8. A modular panel lifter comprising inner and outer telescoping tubes, said inner tube having a first end with a surface engaging base and a fixed collar nut attached proximate a second end, a jack screw threaded through said nut with a stop at a first end preventing unthreading of the screw from the nut and a female socket at a second end by which the screw can be rotated, said jack screw having an abutment shoulder proximate the socket, said outer tube having a first open end within which the inner tube is slidingly received and a second end capped with a cover plate having an aperture within which is mounted said socket in a bushing, a plate in said second end of the second tube with an aperture in which the socket rotates, an axial thrust bearing on the jack screw between the abutment shoulder and the plate, said plate resting on the abutment shoulder through said axial thrust bearing, an adapter for lifting objects attached to the outer tube whereby the load on the adapter is transferred to the screw, said screw laterally reinforced by the inner and outer telescoping tubes.

9. The modular panel lifter of claim 8 wherein the adapter is L-shaped in cross-section with first and second orthogonal legs, said adapter attached to the second tube by the first leg, said second leg having a pair of upstanding fingers adapted to straddle an electrical raceway along a bottom side edge of a modular furniture panel, said raceway flanked by lateral side flanges and said fingers adapted to support the panel by the lateral side flanges.

10. The modular panel lifter of claim 9 wherein the tubing is square in cross-section and two adapters are attached to adjacent sides of the outer tube for lifting two panels attached at right angles forming a corner.

11. The modular panel lifter of claim 8 wherein the surface engaging base is detachable.

* * * * *